US006147617A

United States Patent [19]

Kim

[11] Patent Number: 6,147,617

[45] Date of Patent: Nov. 14, 2000

[54] APPARATUS AND METHOD FOR DETECTING FAULTS IN OUTDOOR DISPLAY

[75] Inventor: Chul Yong Kim, Keunpo-shi, Rep. of Korea

[73] Assignee: Bong Oh Electronics Ind. Co., Ltd., Seoul, Rep. of Korea

[21] Appl. No.: 09/303,662

[22] Filed: May 3, 1999

[30] Foreign Application Priority Data

Jul. 21, 1998 [KR] Rep. of Korea ..... 98-29342

[51] Int. Cl.[7] ..... G08B 21/00

[52] U.S. Cl. ..... 340/664; 340/635; 340/652; 324/556

[58] Field of Search ..... 340/635, 664, 340/652; 324/763, 556

[56] References Cited

U.S. PATENT DOCUMENTS 5,406,213 4/1995 Henley ..... 324/753

FOREIGN PATENT DOCUMENTS 94-904 2/1994 Rep. of Korea .
95-6578 6/1995 Rep. of Korea .

*Primary Examiner*—Julie Lieu
*Attorney, Agent, or Firm*—Oliff & Berridge, PLC

[57] ABSTRACT

The present invention is to provide an apparatus for detecting errors due to cutoff of a unit pixel and short between the unit pixel and the ground voltage level in a lighting-off state, and also a method for checking in a real time whether information data outputted from a remote host computer is normally represented on a display and detecting all the errors due to cutoff of a unit pixel, short between a unit pixel and the ground voltage level, and short between unit pixels.

14 Claims, 9 Drawing Sheets

○ : LEDs TURN ON

△ : SHORT BETWEEN UNIT PIXELS

APPARATUS AND METHOD FOR DETECTING FAULTS IN OUTDOOR DISPLAY

FIELD OF THE INVENTION

The present invention relates to a display; and, more particularly, to an apparatus and a method for detecting faults in the display.

DESCRIPTION OF THE INVENTION

Generally, a display arranges light emitting elements, such as color LEDs (Light Emitting Diodes) and small phosphor indicator tubes on a matrix, and then outputs character-based information, still picture image, dynamic picture image and so on.

Recently, as the size of the display has become larger, a plurality of the displays have been installed on the rooftop of building in a city or on the roadside of a highway, being apart from a host computer which can control each display over wire or wireless.

FIG. 1 is a schematic view illustrating a conventional display. As shown in FIG. 1, a host computer 102 edits display data transmitted to the display in which a plurality of display modules 105 are integrated, and then transmits the edited display data to a main controller 104. The main controller 104 temporarily stores the display data transmitted from the host computer 102 in a memory, and transmits control signal and the display data to the corresponding display modules 105. Display units 107 in the display modules 105 display the display data transmitted from the main controller 104 in response to the control signals of display control units 106.

The display control units 106 in the display modules 105 control the display data from the main controller 104 and then transmit the display data to the display units 107. The display units 107 display the assigned data in response to the control signals of the display control units 106 through the light emitting elements integrated in the display units 107.

The display data of various characters or graphics are transmitted from the remote host computer to the display by wire or wireless communication technology well-known to those skilled in the art, and thus providing various guidance information or advertisements.

However, because the conventional display, which is composed of a plurality of display modules including a plurality of display elements arranged in a matrix form, has been implemented in consideration of only the display output function, the display may not confirm a fault without operator's observation with his eyes, so that the display has problems in that it needs a lot of time and cost for maintenance without a damage to the reliability of information transmission, especially in the case where the damage is left for a long time.

Thus there were a lot of efforts and proposals in order to improve these problems and as an example, "FAULT SELF-DIAGNOSIS CIRCUIT IN DISPLAY" of the Korea patent publication No. 95-6578 published on Jun. 19, 1995 disclosed a method for diagnosing partially and totally whether the display element is faulty or not, by detecting the current value on the display and performing a comparison and a determination with a micro computer control scheme.

Referring to FIG. 2, a current detector 204 of the fault self-diagnosis circuit 200 detects the current on a power line supplied to a display 216 from a power supply unit 202. A level converter 206 amplifies the detected signal using an operational amplifier and an Analog-to-Digital (AID) converter 208 converts an analog output signal of the amplified signal into a digital signal.

A diagnosis controller 210 decodes the converted digital signal and performs a fault diagnosis function, controlling the AID converter 208 and a data selector 214. Also, and the data selector 214 determines whether it will display either a test pattern received from the diagnosis controller 210 or normal information received from the main display control unit 212.

The fault self-diagnosis circuit compares an actually detected current value with a current value which is needed in a normal operation state, analyzes the number of the faulty light emitting elements and carries out lighting-on and lighting-off operations with respect to a plurality of test patterns, by detecting the current on a power line using a current detection sensor attached to the power line of the display, so that the location of a faulty light emitting element can be confirmed.

The fault self-diagnosis circuit shown in FIG. 2 doesn't influence the display at all because of taking the current detection method based on an electromagnetic induction.

However, because the faulty location detection may be made only through a test that performs repeatedly the lighting-on and lighting-off operations with respect to different test modes, the test time for determining the location of a faulty element increases unnecessarily and the primary information output function can't be performed during the test period.

To improve the conventional problems as described above, "LAMP-OPEN DETECTION CIRCUIT FOR VARIABLE DISPLAY BOARD" of the Korea utility publication No. 94-904 published on Feb. 21, 1994 is disclosed as shown in FIG. 2.

Referring to FIG. 3, a lamp-open detection circuit 300 provides a photo coupler 320 between a light emitting lamp 310 and a drive transistor 370. If a lamp control signal (C) outputted from a display board controller 330 is in a high level and then the drive transistor 370 is turned on, the light emitting lamp 310 is turned on.

When the light emitting lamp 310 is turned on, the light emitting diode 321 of the photo coupler 320 emits light, and a photo transistor 322 is turned on so that it is detected whether a lamp has been open or not. That is, when the photo coupler 320 is turned off and the output (D) from the lamp open detection is in a high level, it is determined that the light emitting lamp 310 have been open.

Because the lamp-open detection circuit 300 connects the light emitting lamp 310 to the photo coupler 320, the lamp-open detection circuit 300 has an advantage of a fault detection. However, in the case where the photo coupler 320 consisting of the photo coupler 320 and the light emitting diode 321 is faulty, it is impossible to determine whether such a lamp operation is normally carried out.

Only when each lamp is in such a lighting-on state, the lamp-open detection circuit may detect whether the display is faulty or not.

SUMMARY OF THE INVENTION

It is, therefore, an object of the present invention to provide an apparatus for detecting errors due to cutoff of a unit pixel and short between the unit pixel and the ground voltage level in a lighting-off state.

Another object of the present invention is to provide for a method for checking in a real time whether information data outputted from a remote host computer is normally represented on a display and detecting all the errors due to cutoff of a unit pixel, short between a unit pixel and the ground voltage level, and short between unit pixels.

In accordance with an aspect of the present invention, there is provided in an, outdoor display having a plurality of unit pixels, wherein each of the unit pixels is driven by a driving means in response to a control signal inputted from an external circuit and has a plurality of light emitting devices which are coupled in series to each other, and wherein the light emitting devices have leakage current in a lighting-off state, a fault detection circuit comprising: a current path coupled in parallel to the driving means so that the leakage current flows on the current path in the lighting-off state; and a current sensing means for sensing the leakage current on the current path in the lighting-off state, whereby the fault detection circuit determines that the unit pixel is cut off when any leakage current is not sensed by the current sensing means.

In accordance with another aspect of the present invention, there is provided a fault detection circuit in an electric apparatus having a plurality of element groups to be driven by a driving means in response to a control signal inputted from an external circuit, wherein elements in each of the element groups are electrically connected in series to each other and the element groups are electrically connected in parallel to each other, wherein cutoff of one of elements causes the others to be cut off, and wherein the elements have leakage current in a off-state, the fault detection circuit comprising: a leakage current detecting means for detecting, in the off-state, a cutoff error which is caused by the element groups in the electric apparatus; and a monitoring means for detecting a short error between each element group and a ground voltage level, wherein the monitoring means considers the monitored element group as an error group when the monitored element group operates without an input of the control signal.

In accordance with further another aspect of the present invention, there is provided a fault detection method in a display having a plurality of unit pixels, comprising the steps of: receiving a display check request signal from a controlling means; detecting errors due to cutoff of a unit pixel and short between the unit pixel and a ground voltage level in a lighting-off state, if the received request signal is a request signal for individual dot check; and comparing desired display information data with actually displayed data in the lighting-on state and checking whether errors occur arid then detecting all dots through an individual dot check in the lighting-off state, if the received request signal is a request signal for displayed content check.

BRIEF DESCRIPTION OF THE DRAWINGS

This invention can be more fully understood from the following detailed description when taken in conjunction with the accompanying drawings, in which.

DETAILED DESCRIPTION OF THE INVENTION

Figure 4A:
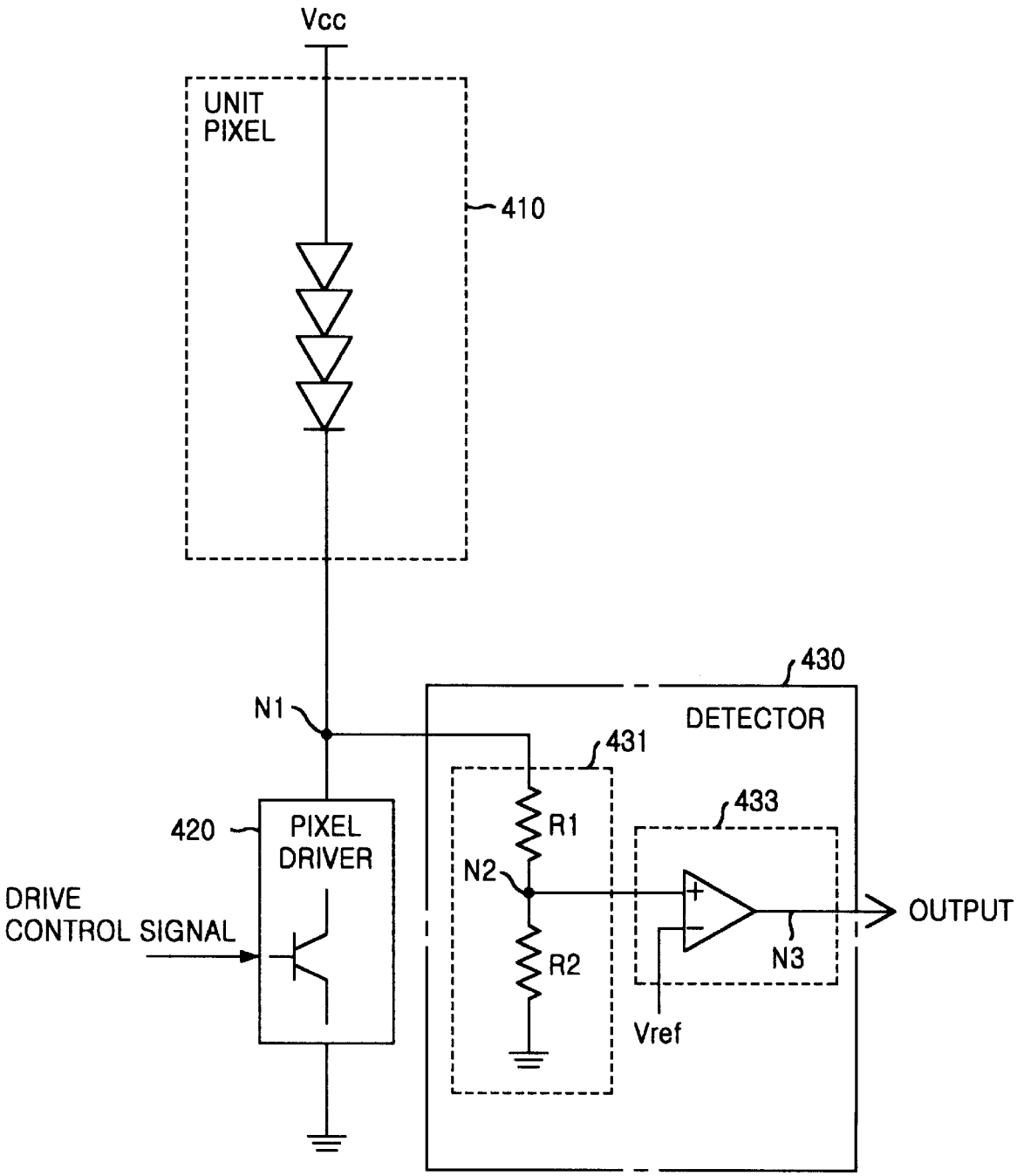
FIG. 4A and FIG. 4B are block diagrams illustrating a fault detection circuit of a display according to the present invention.

Hereafter, the present invention will now be described in detail with reference to the accompanying drawings. FIG. 4A is a block diagram illustrating a fault detection circuit of a display according to the present invention. The fault detection circuit according to the present invention comprises a unit pixel 410, a pixel driver 420, a detector 430 having a voltage divider 431 and a comparator 433.

As shown in FIG. 4A, the pixel driver 420 of the fault detection circuit drives the unit pixel 410 having a plurality of LEDs in response to a control signal inputted from an external circuit. The detector 430 is connected in parallel to the pixel driver 420 and detects a fault without having any influence on the pixel displaying operation.

The voltage divider 431 is connected between node N1 and the ground voltage level and divides a voltage applied at node N1 in compliance with the resistance of a first resistor R1 and a second resistor R2. The comparator 433 determines whether a display element is faulty or not, by comparing the divided voltage provided by the divider 431 with a predetermined reference voltage (Vref).

Preferably, the unit pixel 410 includes a power resistor (not shown in FIG. 4A) so that an excessive current cannot flow into a light emitting element. Also the resistors R1 and R2 of the voltage divider 431 have very great resistance values to minimize the current thereon and then the divided voltage of the resistor R2 is inputted to an operational amplifier (OP AMP). In a preferred embodiment, the voltage divider 431 may include one resistor and one capacitor which are connected in series.

The comparator 433 inputs the voltage applied from the voltage divider 431 to a non-inverting input terminal of the OP AMP and the reference voltage Vref to an inverting input terminal thereof, respectively, thereby performing a comparison function.

The operations of the fault detection circuit according to the present invention will be described in detail.

First, when the pixel driver 420 drives the unit pixel 410 in response to a control signal inputted from an external circuit, the unit pixel 410 is in a lighting-on or lighting-off state. For example, when the display normally operates and the control signal applied to the pixel driver 420 is in a high level, node N1 is in a low level and nodes N2 and N3 of the detector 430 are in a low level. When the display operates normally and the control signal applied to the pixel driver 420 is in a low level, node N1 is in a high level and nodes N2 and N3 of the detector 430 are in a high level.

On the other hand, when the unit pixel 410 is cut off regardless of the control signal applied to the pixel driver 420, the unit pixel 410 always keeps the lighting-off state (even if the control signal is in a high level) and all nodes N1, N2 and N3 are in a low level. Thus, in the lighting-off state of the unit pixel 410 (that is, in the case where the control signal applied to the pixel driver 420 is in a low level), it is determined that the unit pixel 410 is cut off when a micro leakage current from the unit pixel 410 doesn't flow into the detector 430 at all.

When the unit pixel 410 is shorted to the ground voltage level and the control signal applied to the pixel driver 420 is in a high level, the unit pixel 410 operates in the same way as in the normal lighting-on state. However, when the unit pixel 410 is shorted to the ground voltage level and the control signal is in a low level, the unit pixel 410 keeps the abnormal lighting-on state on and all nodes N1, N2 and N3 are in a high level. Thus, in the lighting-off state of the unit pixel 410 (that is, in the case where the control signal applied to the pixel driver 420 is in a low level), it is determined that the unit pixel 410 is shorted to the ground voltage level when the unit pixel 410 is in the abnormal lighting-on state.

The present invention enables the detector 430 to detect a fault even if the unit pixel 410 is in the lighting-off state without influencing the display. The voltage divider 431 connected to the output terminal (N1) of the unit pixel 410 divides a voltage applied at node N1 in compliance with the resistance of the resistor R1 and the resistor R2, and provides an input terminal of the OP AMP with the voltage at node N2. Then, the OP AMP of the comparator 433 compares the voltage at node N2 with the reference voltage, and outputs a signal to the output terminal of the comparator 433 wherein the signal is used for determining whether the unit pixel 410 is faulty or not.

Furthermore, when the control signal applied to the pixel driver 420 is in a low level, the unit pixel 410 may be not driven in the normal state. However, a micro leakage current flows into the voltage divider 431 because the current path is formed through the resistors R1 and R2 of the voltage divider 431 and the internal light emitting element of the unit pixel 410.

The voltage difference between the power voltage (Vcc) and a voltage drop due to the internal resistance of the unit pixel 410 is applied to the voltage divider 431, so that a divided voltage in node N2 is inputted to the comparator 433 and the comparison result is outputted at node N3 as an output of the detection. If the unit pixel 410 is in the cut off state, the voltage at node N2 is in a zero voltage level because a micro leakage current doesn't flow into the voltage divider 431.

Consequently, it is detected that the unit pixel of the lighting-off state is normal when the voltage at node N3 of the comparator 433 is higher than a predetermined voltage and abnormal when the voltage at node N3 of the comparator 433 is lower than the predetermined voltage.

In a preferred embodiment according to the present invention, when the power voltage Vcc is 24V, the operation current of a light emitting element in the unit pixel 410 is 60 mA and the forward voltage is 18V in the lighting-on state of the unit pixel 410, the leakage current of several $\mu$A may flow into the resistors of voltage divider 431 which may have the resistance of 1M ohms in the lighting-off state of the unit pixel 410.

Figure 4B:
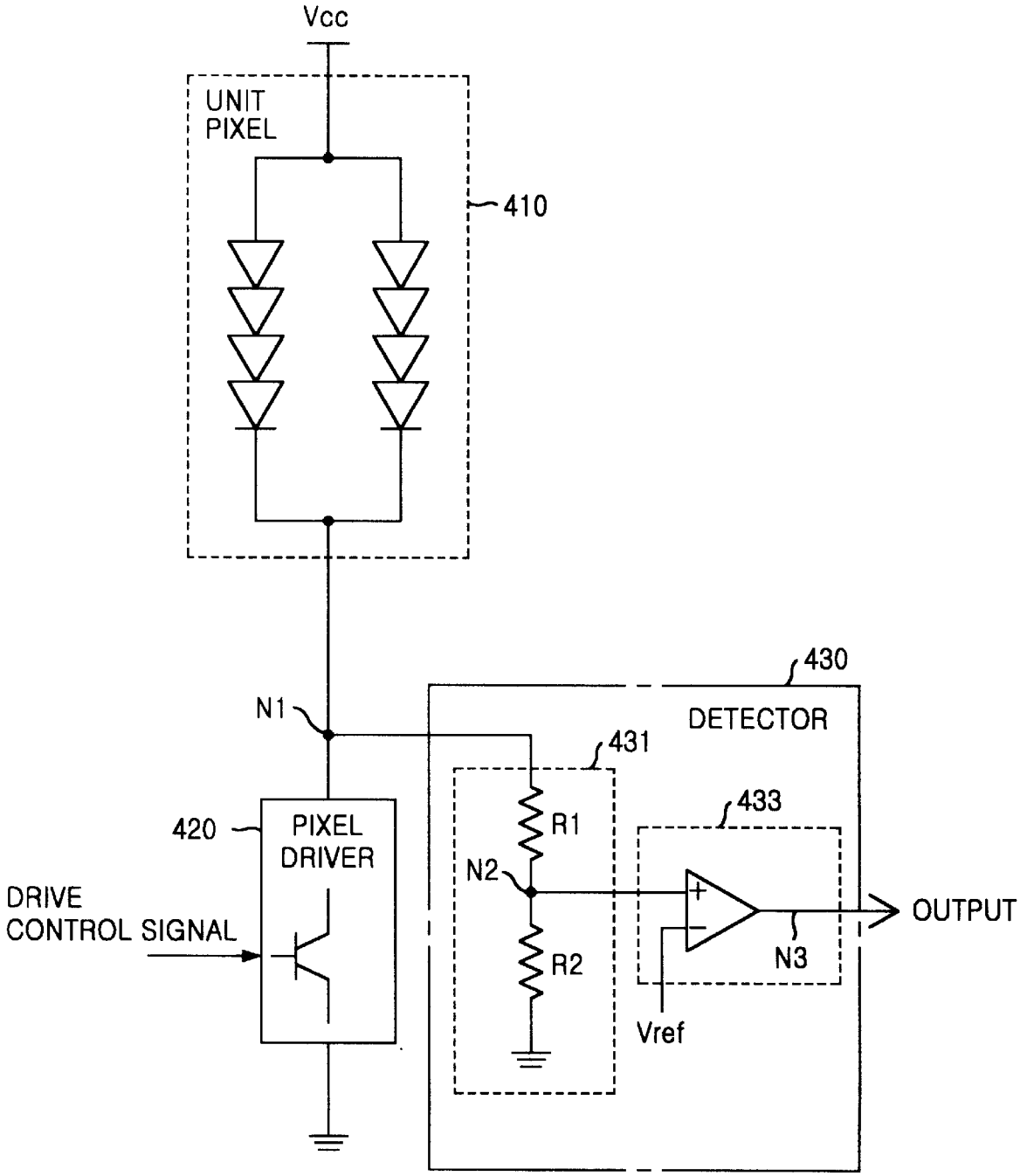

Referring to FIG. 4B, the unit pixel 410 of the fault detection circuit is composed of two LED arrays which are in parallel. When one LED array is cut off, the other LED array also is cut off because it is burned due to overcurrent inputted to the other LED array. Therefore, a serial LED array shown in FIG. 4A has the same effect as the parallel LED arrays shown in FIG. 4B.

As described above, the fault detection circuit according to the present invention uses the micro leakage current (commonly lesser than an operation current) flowing into the light emitting elements of the unit pixel 410 so that the fault detection circuit can easily detect the unit pixel which is faulty, without having any influence on the displaying operation.

Figure 5:
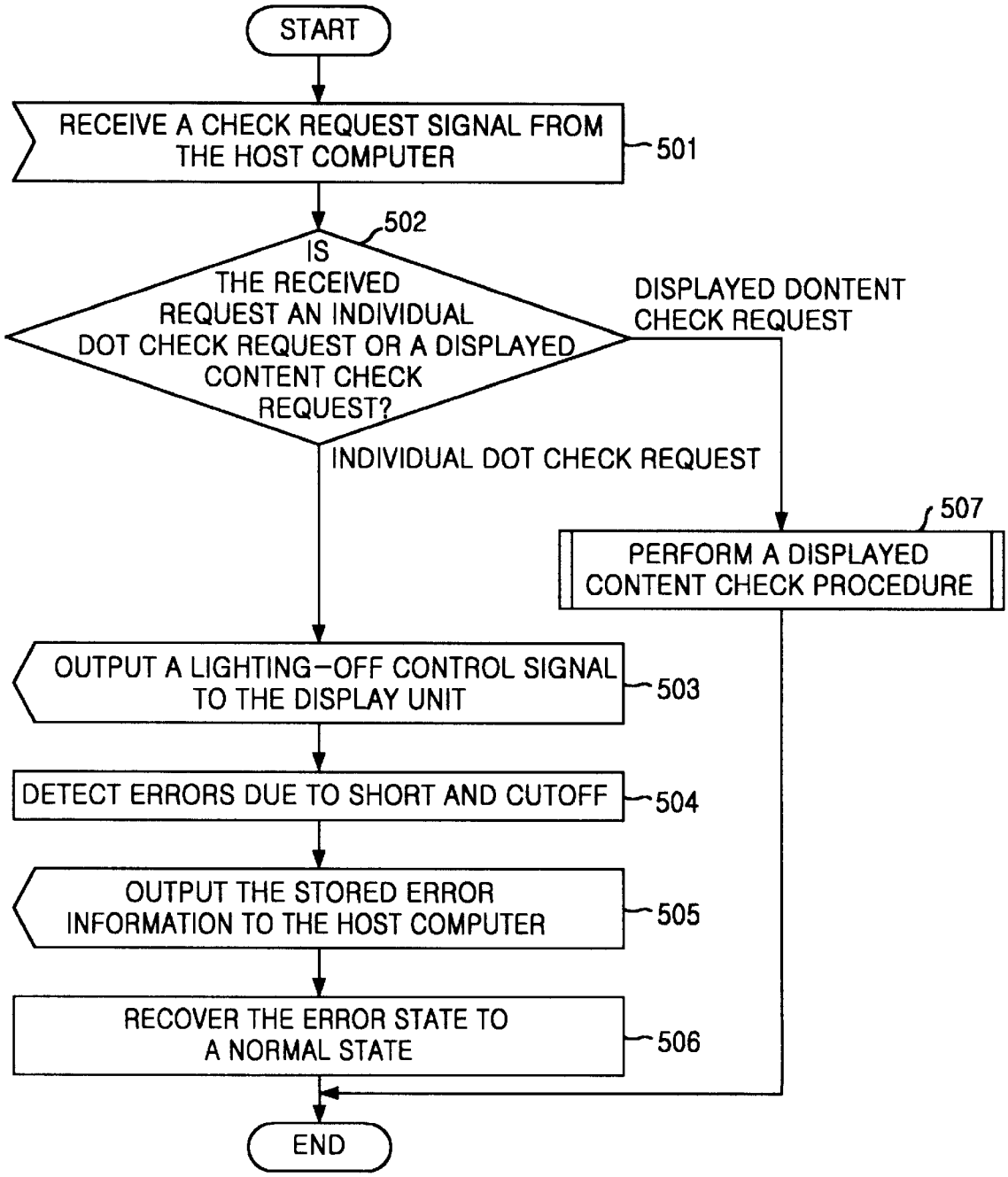
FIG. 5 is a flowchart illustrating a method for detecting faults according to the present invention.

FIG. 5 is a flowchart illustrating a fault detection method of a display according to the present invention.

Referring to FIG. 5, the fault detection method of the display is divided into two check modes, i.e., an individual dot check mode in a lighting-off state and a displayed content check mode in lighting-off and lighting-on states. The individual dot check mode is to detect cutoff of a unit pixel and short between the unit pixel and the ground voltage level and also the displayed content check mode is to detect short between unit pixels as well as the cutoff of the unit pixel and the short between the unit pixel and the ground voltage level.

At step 501, the main controller of the display receives a check request signal from the remote host computer.

At step 502, the main controller (see FIG. 1) determines whether the received request is an individual dot check request for checking the errors of the dots or a displayed content check request for monitoring information contents being displayed on the display board.

Figure 1:
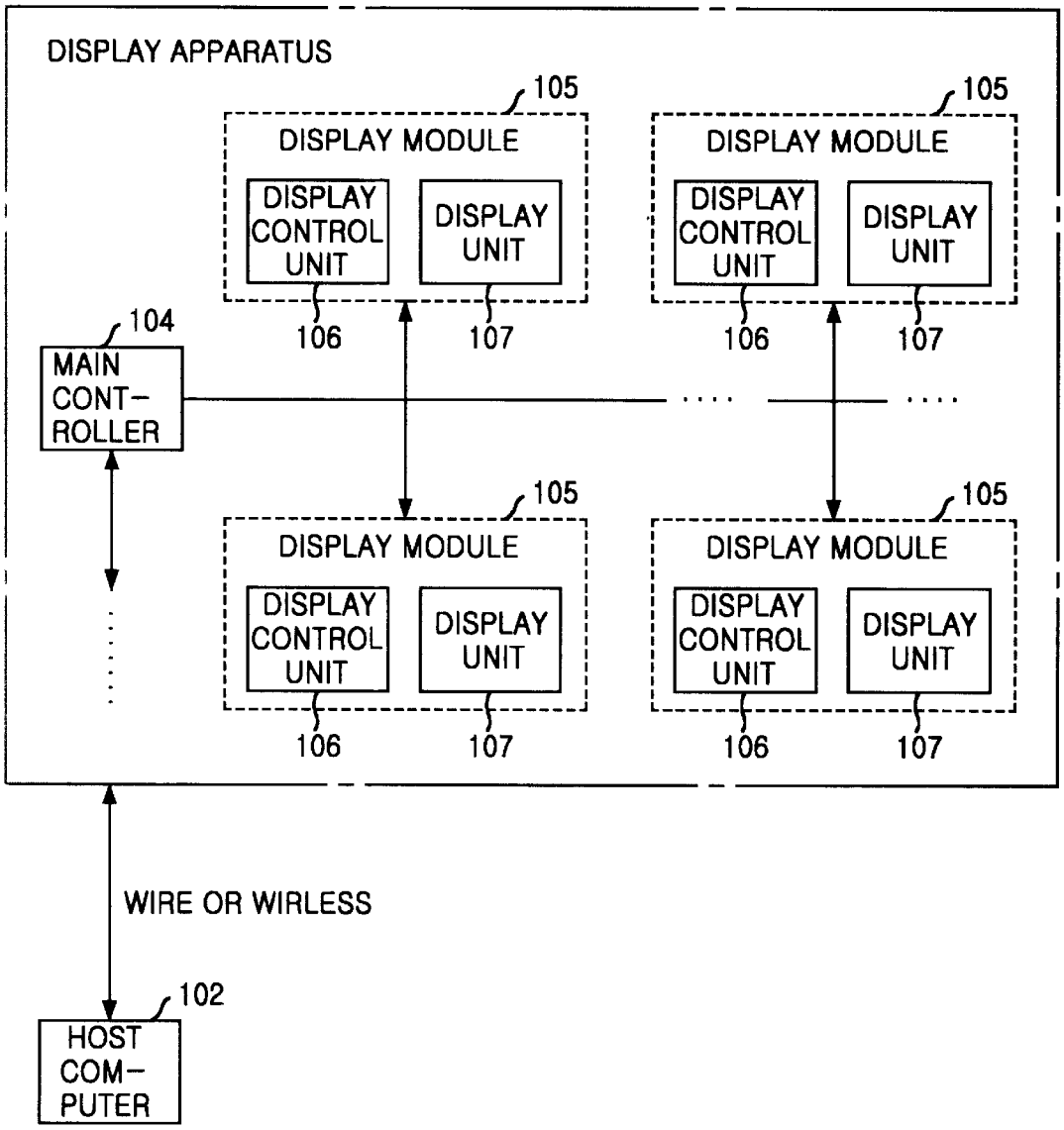
FIG. 1 is a schematic view illustrating a conventional display.
Figure 2:
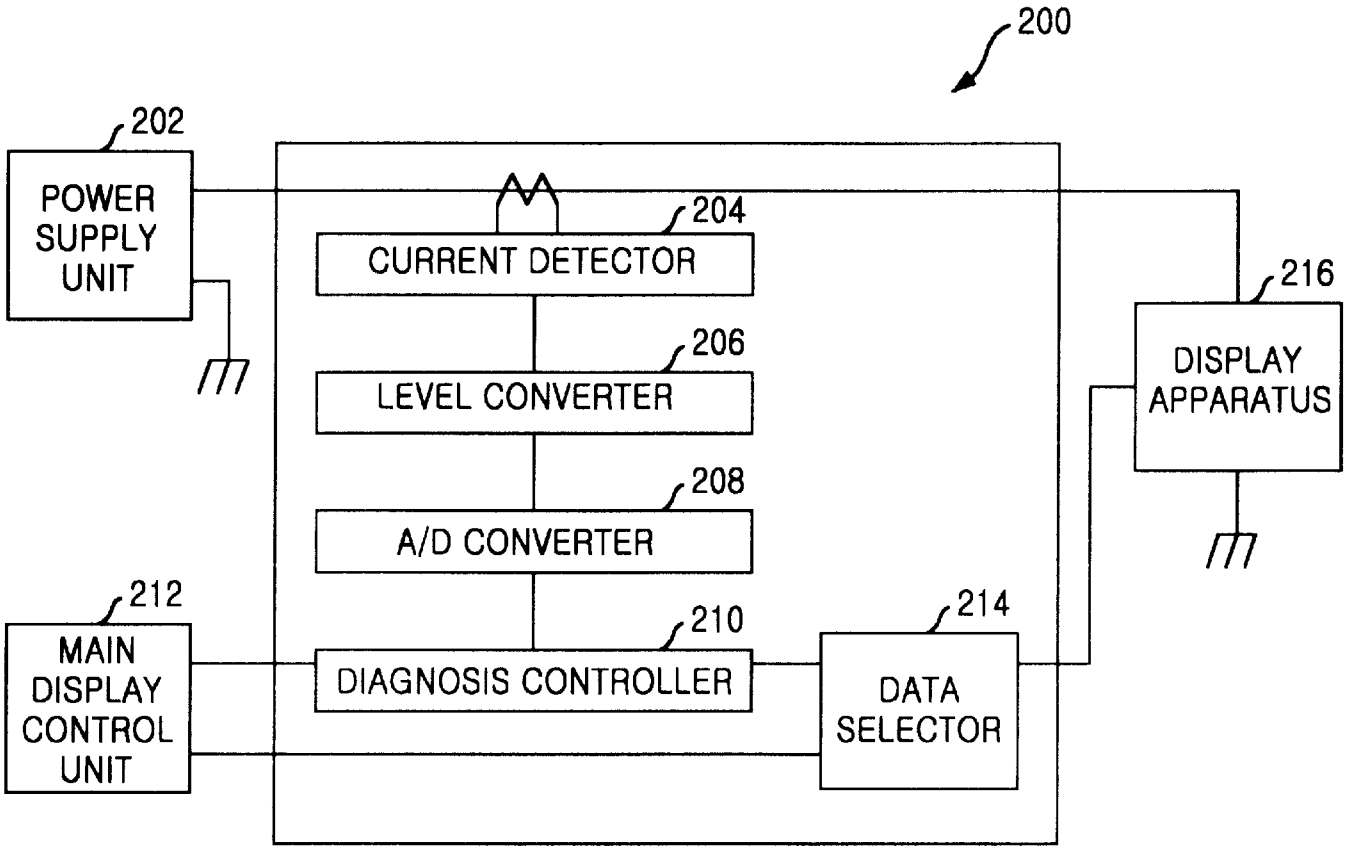
FIG. 2 (PRIOR ART)
FIG. 2 is a block diagram illustrating a fault detection circuit of a display according to the prior art.
Figure 3:
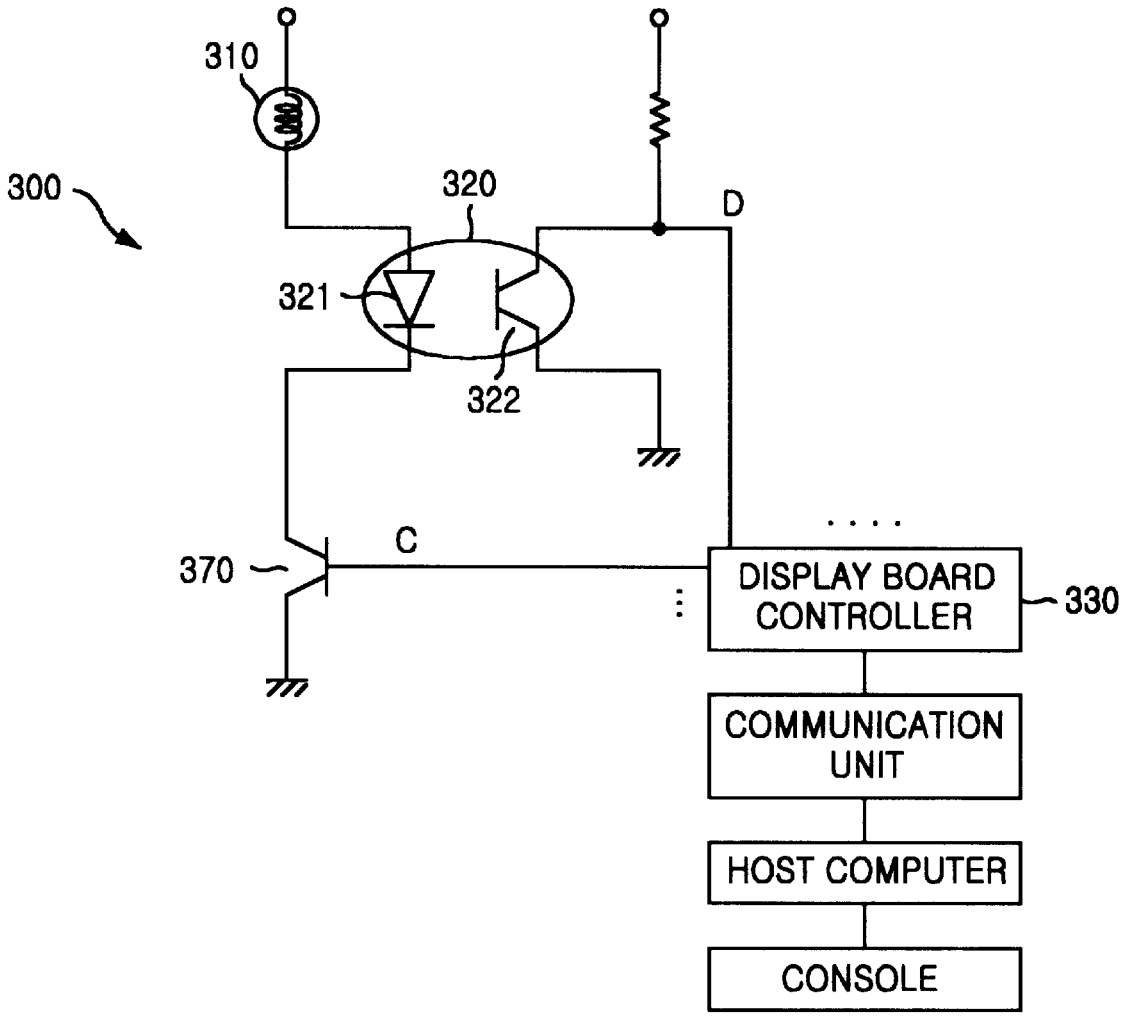
FIG. 3 (PRIOR ART)
FIG. 3 is a block diagram illustrating another fault detection circuit of a display according to the prior art.

At step 503, if the received request is the individual dot check request, the main controller outputs a lighting-off control signal (the drive control signal) to the fault detection circuit (see FIGS. 4A and 4B) of the display control unit (see FIG. 1).

At step 504, the fault detection circuit detects errors due to the short between the unit pixel and the ground voltage level, and the cutoff of the unit pixel using the micro leakage current, and then stores the detected error information in the display control unit. In other words, when the unit pixel is turned on even if the drive control signal is not inputted into the pixel driver, the short is detected between the unit pixel and the ground voltage level. Also, if the micro leakage current doesn't flow into the detector, the display unit determines that the unit pixel is cut off.

At step 505, the main controller receives the error information output request from the remote host computer, reads the stored error information from the display control unit, and outputs it to the remote host computer.

At step 506, the host computer receives the error information so that the error state can be recovered to the normal state.

On the other hand, at step 507, if the received request is the displayed content check request, the main controller performs a displayed content check procedure. The displayed content check procedure will be described in conjunction with FIG. 6.

On the other hand, there can be three kinds of error patterns in the display. That is, these errors are generated in the short between the unit pixel and the ground voltage level, the cutoff of the LEDs in the unit pixel and an additional short between the unit pixels. FIG. 6 and FIGS. 7A through 7E illustrate a method for detecting theses errors by comparing an intended display data with actually displayed data.

Figure 6:
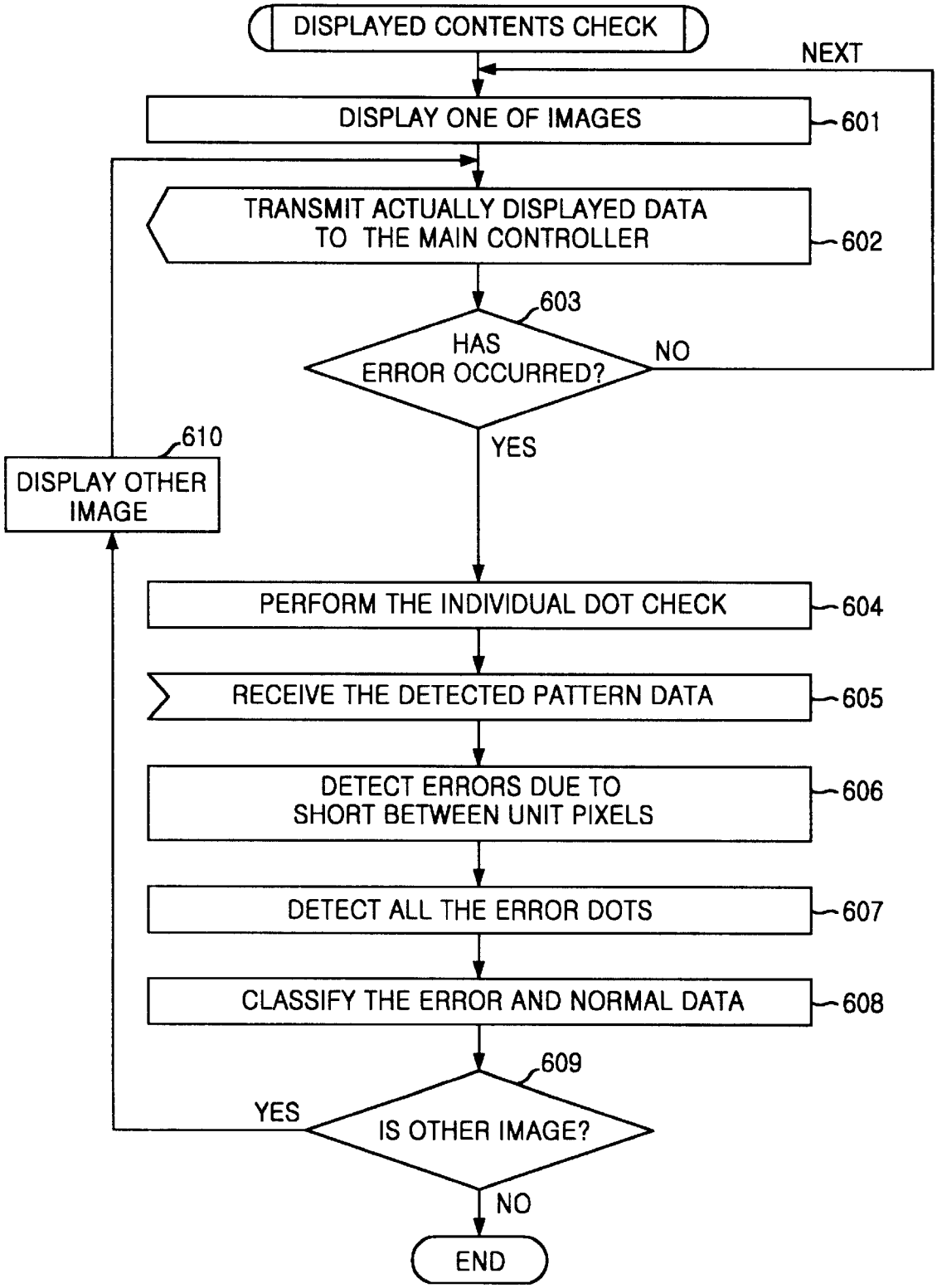
FIG. 6 is a detailed flowchart illustrating a display pattern check procedure of FIG. 5.

Referring to FIG. 6, at step 601, the display control unit (see FIG. 1) of the display module outputs an intended display data (see an intended display pattern of FIG. 7C) to the display unit (see FIG. 1) so that one of images can be displayed by the intended display data. This check mode is carried out on the base of pattern blocks.

At step 602, the display unit transmits actually displayed data (see FIG. 7D) to the main controller.

At step 603, the main controller compares the intended display data with the actually displayed data, and then determines whether error has occurred.

Figure 7A:
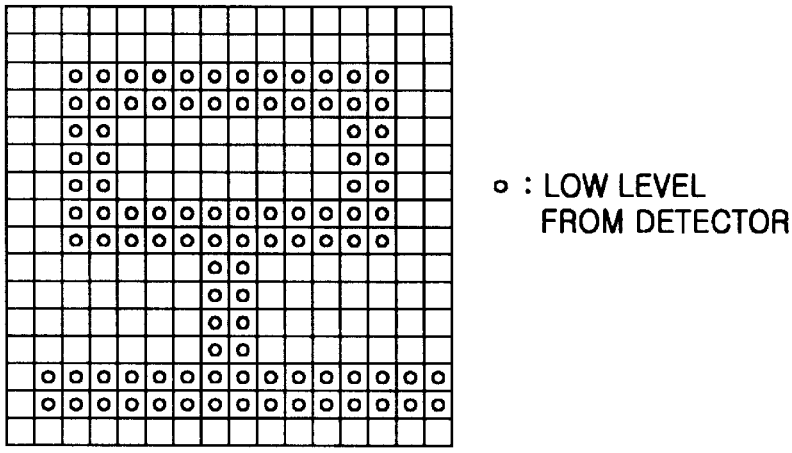
FIG. 7A through FIG. 7E show display patterns for describing display state.
Figure 7B:
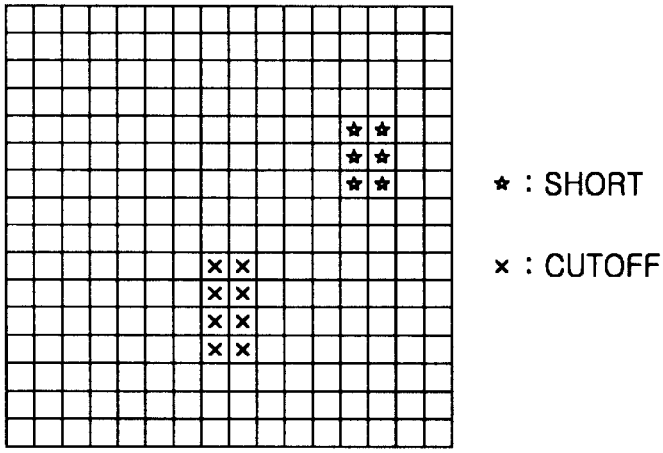
Figure 7C:
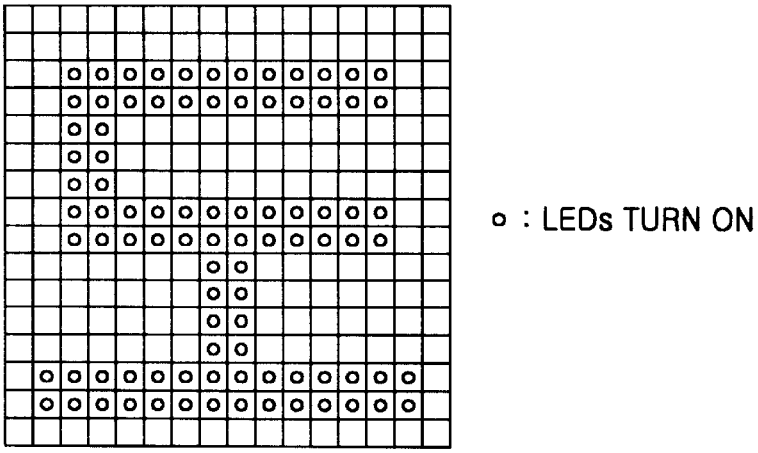

At step 604, if the location at which error has occurred is confirmed, the main controller performs the individual dot check procedure that is implemented in step 503 and step 504 as shown in FIG. 5 in order to detect the kind of errors. That is, the fault detection circuit detects errors due to short between the unit pixel and the ground voltage level, and cutoff of the unit pixel using the micro leakage current. The results of step 604 may be represented in such as patterns of FIG. 7B. In FIG. 7B, the "x" marks denote cutoff errors of the unit pixels which keep on the lighting-off state, and the "☆" marks denote short errors between the unit pixel and the ground voltage level.

At step 605, the display control unit receives detected pattern data (FIG. 7A) from the fault detection circuit and then transmits the detected pattern data to the main controller. Such detected pattern data are based on output signal levels of the fault detection circuit. That is, when output signals of the fault detection circuit are in a low level with respect to unit pixels corresponding to the dots, the marks "o" may be indicated in FIG. 7A. Also, when output signals of the fault detection circuit are in a high level with respect to unit pixels corresponding to dots, any marks are not positioned in the corresponding dots as shown in FIG. 7A. Accordingly, the marks in the FIG. 7A indicate that the outputs from the fault detection circuit are in a low level. At step 606, the main controller subtracts the pattern values of FIG. 7B and FIG. 7C from the pattern values of FIG. 7A (the pattern values of FIG. 7A–(the pattern values of FIGS. 7B and 7C)), thereby detecting errors due to short between unit pixels.

At step 607, the main controller sums the short errors between unit pixels and the pattern value of FIG. 7B, thereby detecting all the error dots.

Figure 7D:
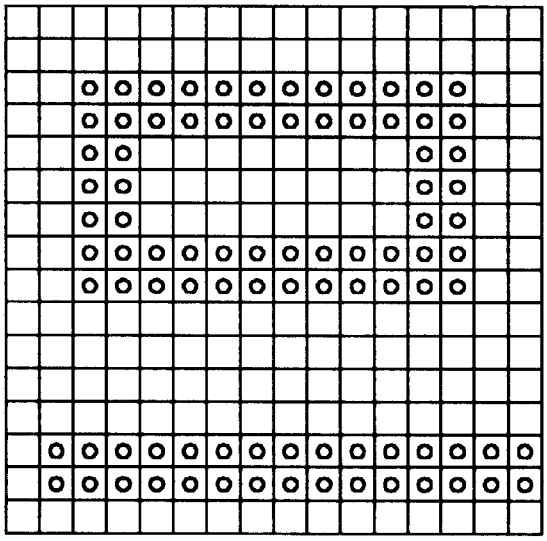
Figure 7E:
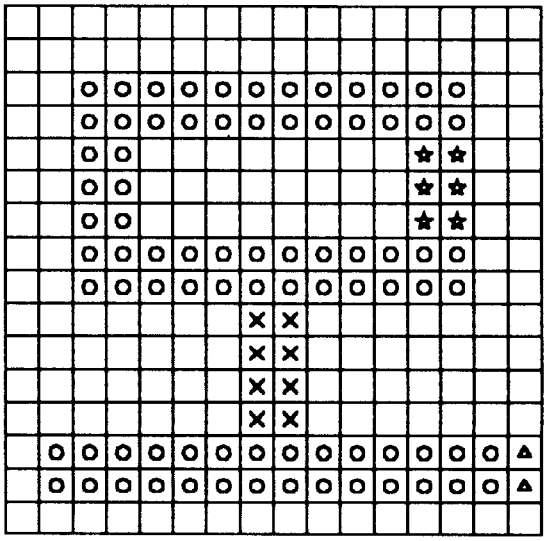

Then, as shown in FIG. 7E, at step 608, the main controller classifies and displays the error and normal data and the "Δ" mark in FIG. 7D illustrates an error between unit pixels.

At step 609, the display control unit determines whether other image exists, at step 610, the display unit displays other image and then step 602 to step 608 as described above are performed repeatedly.

When the display easily stores and manages an error check result and a maintenance result in the database through the fault detection circuit according to the present invention, the display may confirm its history and enables the efficient maintenance.

The fault detection circuit (see FIG. 4*a* and FIG. 4B) according to the present invention may detect simply the fault of each display element and the corresponding fault location without influencing the information display operation of a display element. The fault detection circuit may improve prominently the reliability of information display operation because of excluding the execution of the complicated test mode (for example, a test mode using a special pattern such as a horizontal line, a vertical line, an oblique line and so on) for identifying the fault location. The fault detector in the fault detection circuit is made of a semi-permanent component as compared with the life length of the unit pixel, thus improving prominently the reliability of the fault detection operation while minimizing the fault occurrence of the fault detector itself.

Because the fault detection method using the fault detection circuit may monitor the present display state in real time from a remote place, thus improving the convenience of error correction and maintenance without seeing the display with eyes.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. In an outdoor display having a plurality of unit pixels, wherein each of the unit pixels is driven by a driving means in response to a control signal inputted from an external circuit and has a plurality of light emitting devices which are coupled in series to each other, and wherein the light emitting devices have leakage current in a lighting-off state, a fault detection circuit comprising:

a current path coupled in parallel to the driving means so that the leakage current flows on the current path in the lighting-off state; and a current sensing means for sensing the leakage current on the current path in the lighting-off state, whereby the fault detection circuit determines that the unit pixel is cut off when any leakage current is not sensed by the current sensing means.

2. The fault detection circuit in accordance with claim 1, wherein the current sensing means comprises:

a current-to-voltage converting means formed on the current path for converting the leakage current into voltage level; and a comparator for comparing the converted voltage with a reference voltage.

3. The fault detection circuit in accordance with claim 2, wherein the unit pixel comprises a plurality of groups having the plurality of light emitting devices and wherein the groups are coupled in parallel to each other.

4. The fault detection circuit in accordance with claim 3, wherein the unit pixel is cut off when one of the groups is cut off.

5. The fault detection circuit in accordance with claim 1, wherein the current sensing means comprises a voltage divider, wherein the divider means comprises:

a first resistor connected to an output terminal of the unit pixel; and a second resistor connected between the first resistor and a ground voltage level.

6. The fault detection circuit in accordance with claim 1, wherein the current sensing means comprises a voltage divider, wherein the divider means comprises:

a resistor connected to an output terminal of the unit pixel; and a capacitor connected between the resistor and a ground voltage level.

7. A fault detection circuit in an electric apparatus having a plurality of element groups to be driven by a driving means in response to a control signal inputted from an external circuit, wherein elements in each of the element groups are electrically connected in series to each other and the element groups are electrically connected in parallel to each other, wherein cutoff of one of elements causes the others to be cut off, and wherein the elements has leakage current in an off-state, the fault detection circuit comprising:

a leakage current detecting means for detecting, in the off-state, an cutoff error which is caused by the element groups in the electric apparatus; and a monitoring means for detecting a short error between each element group and a ground voltage level, wherein the monitoring means considers the monitored element group as an error group when the monitored element group operates without an input of the control signal.

8. The fault detection circuit in accordance with claim 7, wherein the leakage current detecting means comprises:

a current-to-voltage converting means formed on a current which is coupled in parallel to the driving means, for converting the leakage current into voltage level; and a comparator for comparing the converted voltage with a reference voltage.

9. The fault detection circuit in accordance with claim 8, wherein the leakage current detecting means comprises a voltage divider, wherein the divider means comprises:

a first resistor connected to an output terminal of the unit pixel; and a second resistor connected between the first resistor and a ground voltage level.

10. The fault detection circuit in accordance with claim 8, wherein the leakage current detecting means comprises a voltage divider, wherein the divider means comprises:

a resistor connected to an output terminal of the unit pixel; and a capacitor connected between the resistor and a ground voltage level.

11. A fault detection method in a display having a plurality of unit pixels, comprising the steps of:

(a) receiving a display check request signal from a controlling means;

(b) detecting errors due to cutoff of a unit pixel and short between the unit pixel and a ground voltage level in a lighting-off state, if the received request signal is a request signal for individual dot check; and (c) comparing desired display information data with actually displayed data in the lighting-on state and checking whether errors occur and then detecting all dots through an individual dot check in the lighting-off state, if the received request signal is a request signal for displayed content check.

12. The fault detection method in accordance with claim 11, wherein the (b) step comprises:

outputting a lighting-off control signal from the controlling means to a fault detection circuit;

detecting errors due to the short between the unit pixel and the ground voltage level, and the cutoff of the unit pixel using the micro leakage current on the unit pixel and then storing the detected error information in the display control unit; and reading the stored error information from the display control unit.

13. The fault detection method in accordance with claim 12, wherein the (c) step comprises:

outputting the desired display information data from the display control unit to the display unit so that an image can be displayed by the desired display information data;

comparing the display information data with the actually displayed data in the controlling means and checking whether the errors have occurred;

outputting the lighting-off control signal from the controlling means to the fault detection circuit of the display control unit;

detecting errors due to the short between the unit pixel and the ground voltage level, and the cutoff of the unit pixel using the micro leakage current on the unit pixel and then storing the detected error data in the display control unit;

detecting pattern data through a fault detection circuit in a lighting-on state and transmitting the detected pattern data from the display control unit to the controlling means;

subtracting the desired display information data and the detected error data from the detected pattern data, thereby detecting short errors between unit pixels; and summing errors due to the cutoff of the unit pixel and the short between the unit pixel and the ground voltage level, and the short errors between the unit pixels, thereby detecting all the error dots.

14. The fault detection method in accordance with claim 13, wherein the error detecting step in the lighting-off state comprises:

detecting error due to the cutoff of the unit pixel when the unit pixel is normally lighted off in the lighting-off state and the micro leakage current doesn't flow into the fault detection circuit from the unit pixel; and detecting errors due to the short between the unit pixel and the ground voltage level when the unit pixel is abnormally lighted on in the lighting-off state and the micro leakage current doesn't flow into the fault detection circuit from the unit pixel.

* * * * *